US006619306B2

(12) United States Patent
Ma

(10) Patent No.: US 6,619,306 B2
(45) Date of Patent: Sep. 16, 2003

(54) PARASOL OPENING DEVICE

(76) Inventor: Mark J. S. Ma, 16633 Laurelbrook Way, Cerritos, CA (US) 90703

( * ) Notice: Subject to any disclaimer, the term of this patent is extended or adjusted under 35 U.S.C. 154(b) by 32 days.

(21) Appl. No.: 09/803,963

(22) Filed: Mar. 13, 2001

(65) Prior Publication Data

US 2002/0129847 A1 Sep. 19, 2002

(51) Int. Cl.[7] ..... A45B 11/00; A45B 17/00
(52) U.S. Cl. ..... 135/21; 135/20.3
(58) Field of Search ..... 135/90, 98, 20.1, 135/21, 127, 121, 124, 20.3, 120.1, 120.3, 120.4, 19, 25.4

(56) References Cited

U.S. PATENT DOCUMENTS

| | | | | | |
|---|---|---|---|---|---|
| 5,735,302 | A | * | 4/1998 | Saliva | 135/20.1 |
| 5,937,882 | A | * | 8/1999 | Harbaugh | 135/20.3 |
| 5,960,806 | A | * | 10/1999 | Steiner | 135/20.1 |
| 6,014,980 | A | * | 1/2000 | Glatz | 135/20.1 |
| 6,196,242 | B1 | * | 3/2001 | Xu | 135/20.1 |
| 6,230,727 | B1 | * | 5/2001 | Chen | 135/98 |
| 6,321,763 | B1 | * | 11/2001 | Ma | 135/20.1 |

FOREIGN PATENT DOCUMENTS

| | | |
|---|---|---|
| GB | 2266234 | * 10/1993 |

* cited by examiner

*Primary Examiner*—Lanna Mai
(74) *Attorney, Agent, or Firm*—Rosenberg, Klein & Lee

(57) ABSTRACT

A parasol opening device is incorporated in a parasol for opening/closing a canopy of the parasol. The parasol includes a tubular post for movably receiving the parasol opening device therein. The parasol opening device is movable along the post between an open position and a closed position. A canopy support arm has a first end pivotally attached to the parasol opening device and a second end to which a canopy system is pivoted. A link has a first end pivoted to the post and a second end pivotally attached to a slide which is movable along the arm. A rope having a predetermined and fixed length partially extends through the post, the parasol opening device and the arm with a first end of the rope fixed to the post and a second end of the rope attached to a runner of the canopy system whereby driving the rope causes the canopy system to open/close. The parasol opening device includes a movement control device for guiding/controlling the parasol opening device to move along the post between the open position and the closed position and thus driving the rope to open/close the canopy system.

9 Claims, 6 Drawing Sheets

PARASOL OPENING DEVICE

FIELD OF THE INVENTION

The present invention generally relates to a large-sized parasol having a canopy sideways supported by a post, and in particular to a device for controlling canopy opening/closing of the large-sized parasol.

BACKGROUND OF THE INVENTION

Umbrellas and parasols are commonly used in shielding people in sunny and rainy areas. A common structure of umbrellas and parasols includes a central post along which a runner is movably mounted. A crown is attached to a top end of the central post. Ribs extend from the crown for supporting a canopy. Stretchers extend from the runner and pivoted to the ribs whereby by moving the runner along the central post, the ribs are caused to move toward/away from the central post and thus opening/closing the canopy.

Such a structure works well for small-sized umbrellas. However, for large-sized parasols which is generally for shielding sun light, the central post stands for a problem in efficient use of the space under the canopy. Thus large-sized parasols with sideways support canopy are available in the market. A mechanism to open the canopy of such large-sized parasols includes a rope which drives the canopy between an open position and a closed position. The mechanism, however, requires a complicated and thus expensive structure.

It is thus desirable to provide a parasol opening device having a simple and thus cheap structure for overcoming the above problem.

SUMMARY OF THE INVENTION

Accordingly, an object of the present invention is to provide a parasol opening device having a simple structure.

Another object of the present invention is to provide a parasol opening device that is easy to operate.

To achieve the above objects, in accordance with the present invention, there is provided a parasol opening device adapted to be incorporated in a parasol, wherein the parasol comprising a tubular post for movably receiving the parasol opening device therein, the parasol opening device being movable along the post between a first position and a second position, an arm having a first end pivotally attached to the parasol opening device and a second end to which a canopy system is pivoted, a link having a first end pivoted to the post and a second end pivotally attached to a slide which is movable along the arm and a rope having a predetermined and fixed length, the rope partially extending through the post, the parasol opening device and the arm with a first end of the rope fixed to the post and a second end of the rope attached to a runner of the canopy system whereby driving the rope causes the canopy system to open/close, the parasol opening device comprising a movement control device for guiding/controlling the parasol opening device to move along the post between the open position and the closed position and thus driving the rope to open/close the canopy system.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 2:
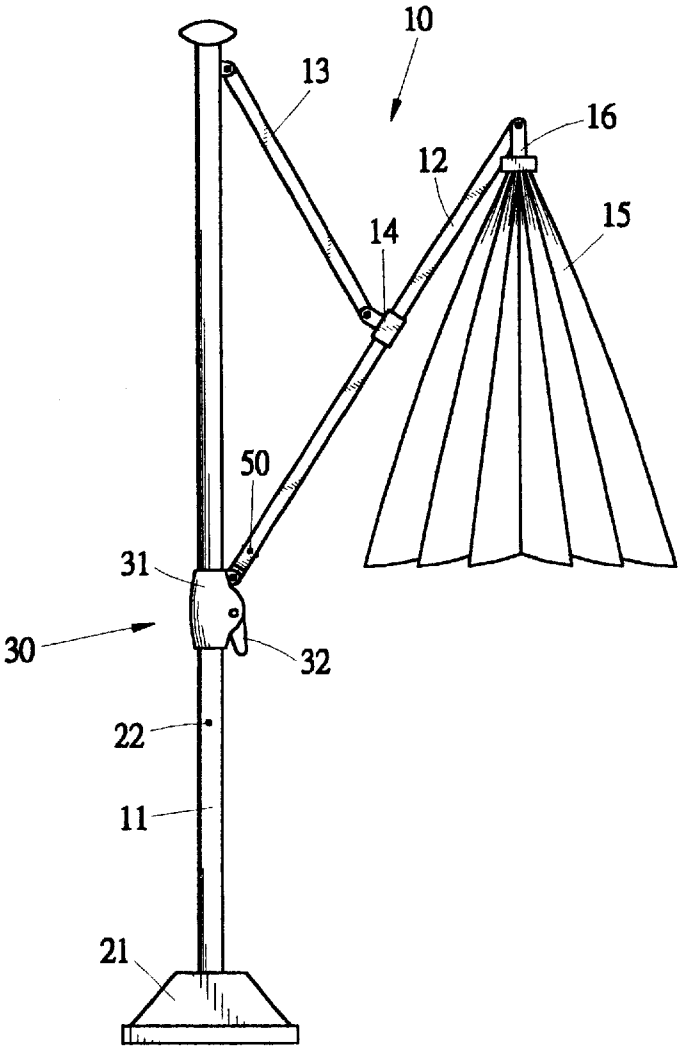
FIG. 2 is similar to FIG. 1 but the parasol being in a closed position.
Figure 1:
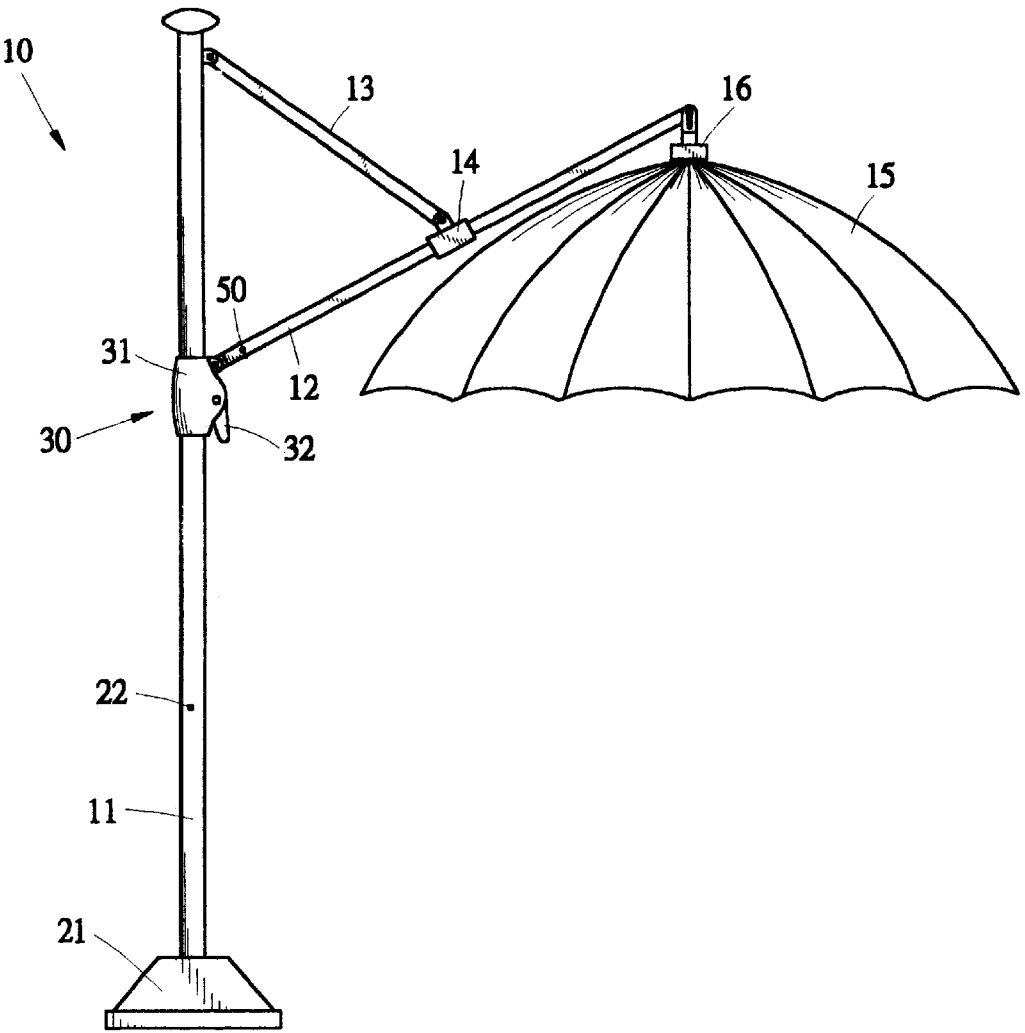
FIG. 1 is a side elevational view of a large-sized parasol incorporating a parasol opening device constructed in accordance with the present invention, the parasol being in an open position.

With reference to the drawings and in particular to FIGS. 1 and 2, a parasol 10 in which a parasol opening device in accordance with the present invention is embodied comprises an upright post 11 having a lower end fixed to a base 21 for being firmly positioned on for example the ground. The parasol opening device of the present invention, generally designated with reference numeral 30, is mounted to the post 11 to be axially movable therealong. A canopy support arm 12 has a proximate end pivoted to the parasol opening device 30 and a remote end to which a canopy system comprising a canopy 15 is attached. A link 13 has two ends respectively pivoted to the post 11 at a location higher than the parasol opening device 30 and a slide 14 movably attached to the canopy support arm 12.

When the parasol opening device 30 is moved between an open position as shown in FIG. 1 to a closed position as shown in FIG. 2, the canopy support arm 12, under the support of the link 13, is forced to rotate toward the post 11 about the pivotal joint between the arm 12 and the parasol opening device 30.

Figure 4:
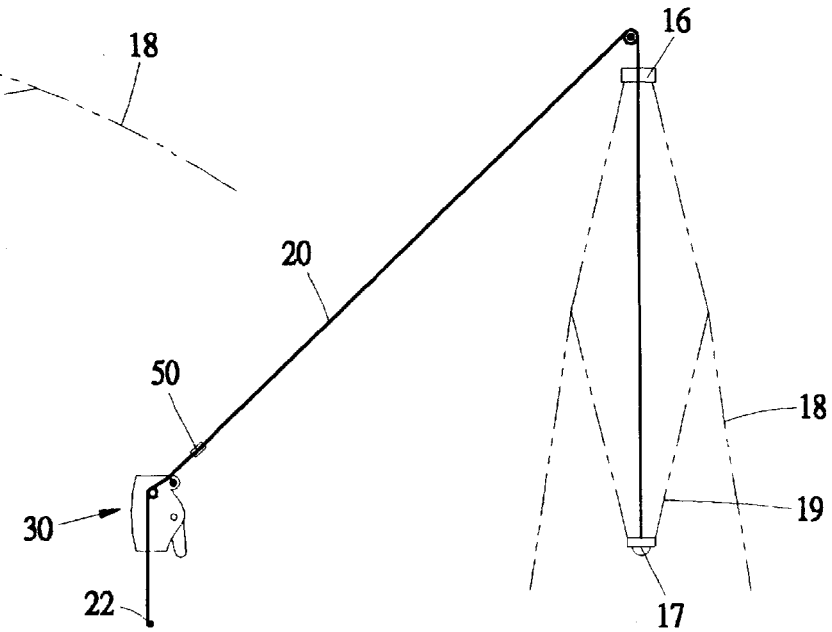
FIG. 4 is a schematic view showing the rope system in the closed position.
Figure 3:
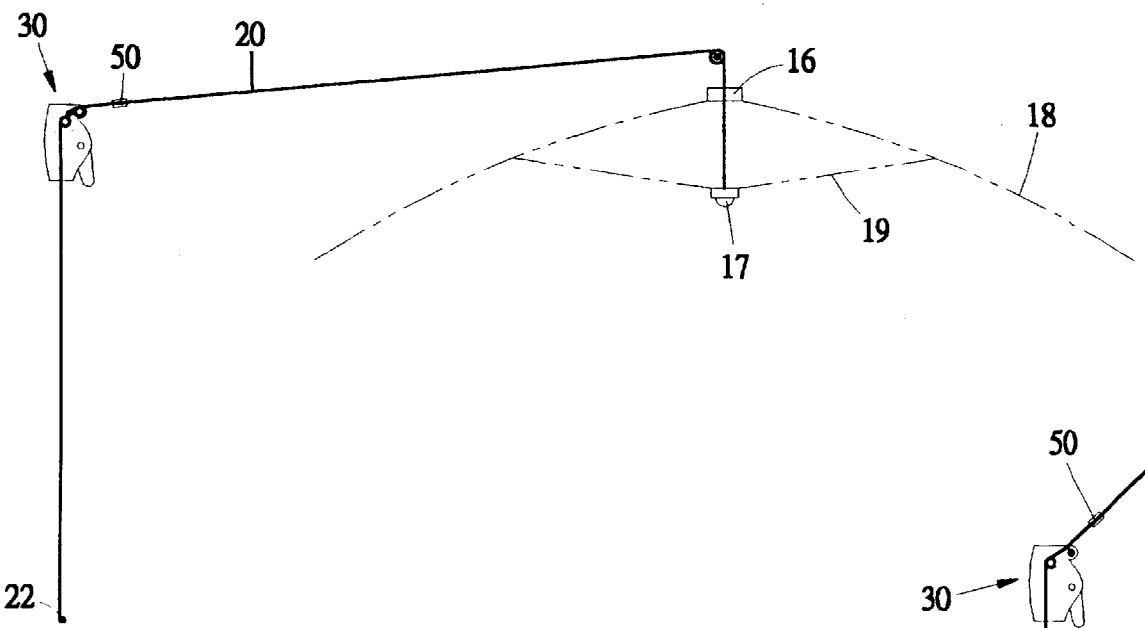
FIG. 3 is a schematic view showing a rope system of the parasol in the open position.

Also referring to FIGS. 3 and 4, the canopy system comprises a crown 16 pivoted to the canopy support arm 12 from which a plurality of ribs 18 radially extends and a runner 17 from which a plurality of stretchers 19 extends. Remote ends of the stretchers 19 are respectively pivoted to the ribs 18. The canopy 15 is attached to and supported by the ribs 18.

A rope 20 comprises a proximate section located within and being fixed to the post 11 by a pin 22, an intermediate section extending over a roller 33 (FIG. 6) inside the parasol opening device 30 and along the canopy support arm 12 and a remote section extending over the pivotal joint between the crown 16 and the canopy support arm 12. The remote end of the rope 20 further extends through the crown 16 and fixed to the runner 17 whereby the canopy 15 may be opened by controlling the rope 20 to move the runner 17 toward/away from the crown 16.

Preferably, the canopy support arm 12 is an elongate hollow member through which the rope 20 extends.

The rope 20 has a predetermined and fixed length such that when the parasol opening device 30 is located at the open position, the runner 17 of the canopy system is forced to locate close to the crown 16 thereby opening the canopy 15. When the parasol opening device 30 is moved to the closed position, which shortens the length of the proximate section of the rope 20 located within the post 11 and therefore increasing the length of the remote section of the rope 20 (due to the fact that the rope 20 has a fixed length) thereby allowing the runner 17 to move away from the crown 16 under spring force of the stretchers 19 and the ribs 18 and therefore closing the canopy 15.

Figure 5:
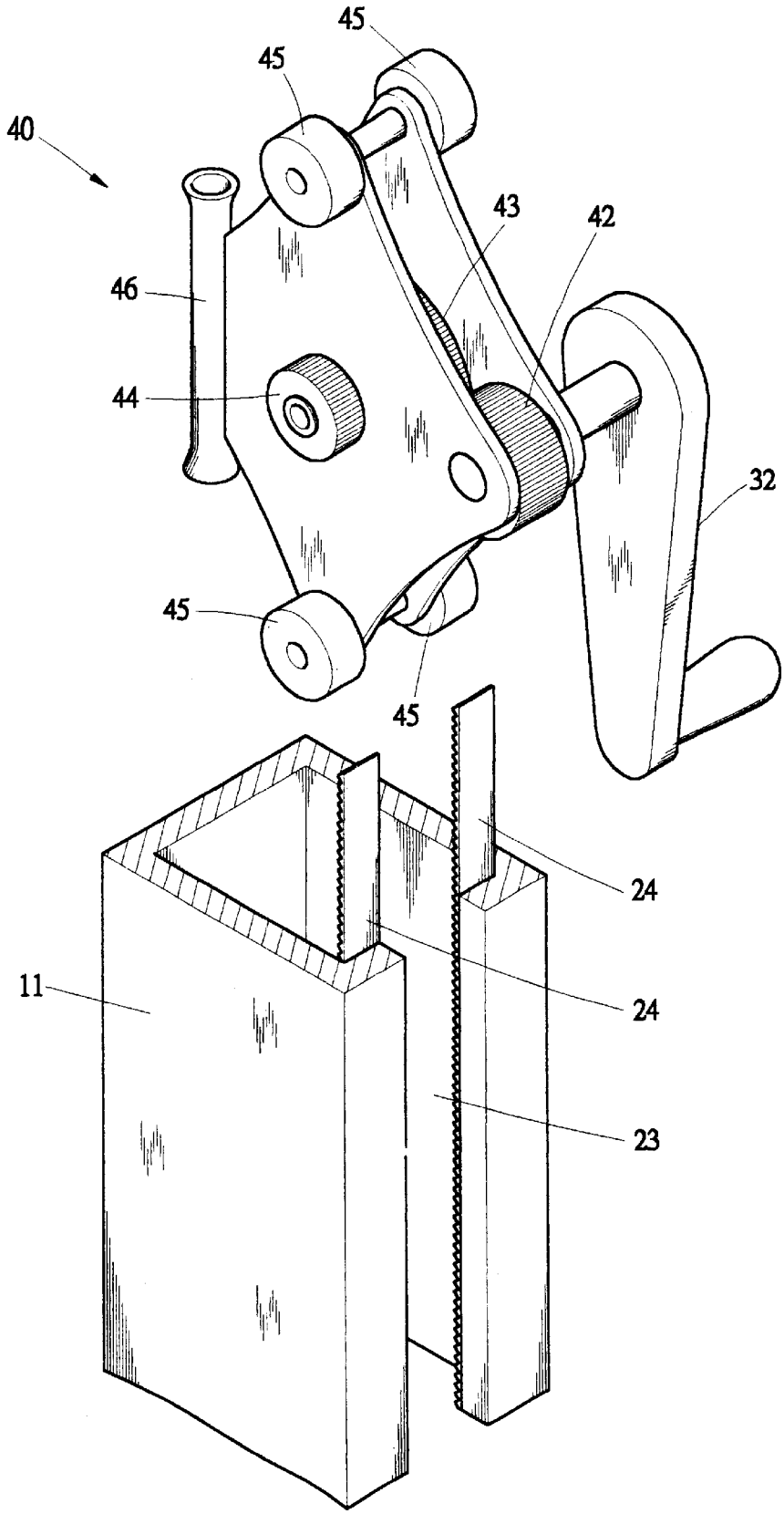
FIG. 5 is a perspective view showing the parasol opening device of the present invention with a casing thereof being removed.
Figure 6:
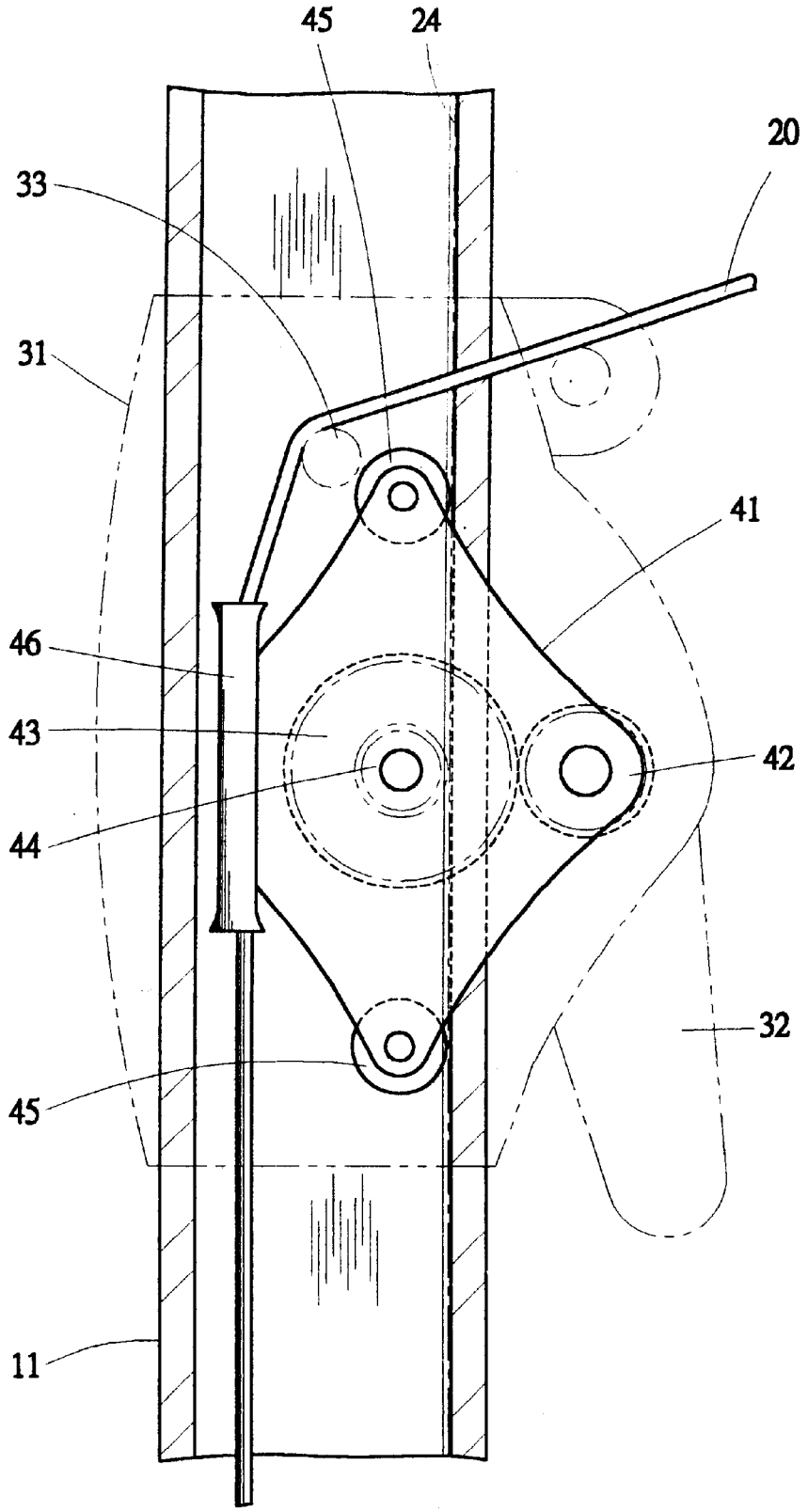
FIG. 6 is a side elevational view of the parasol opening device, the casing being shown in dash lines.
Figure 7:
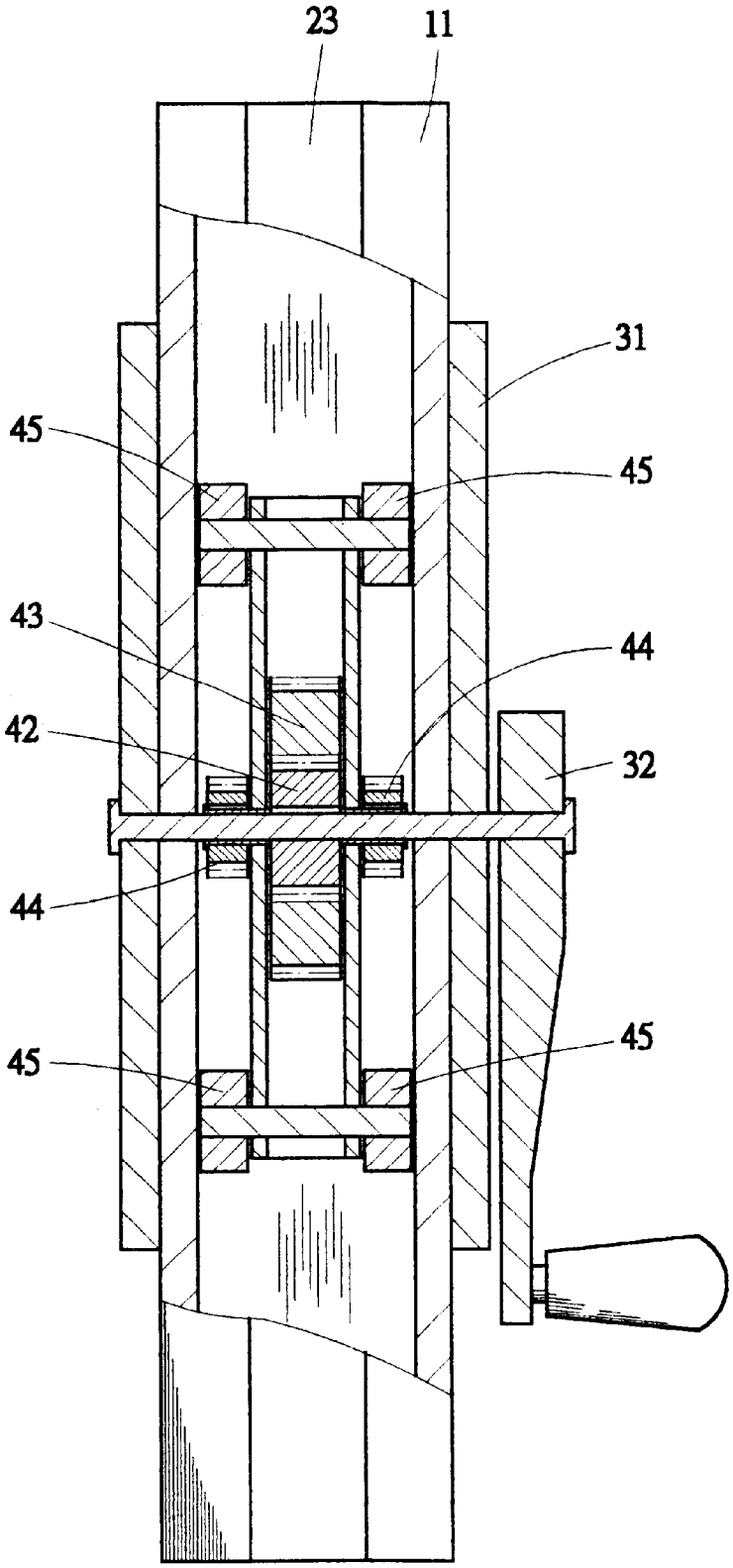
FIG. 7 is a cross-sectional view of the parasol opening device of the present invention.

Further referring to FIGS. 5–7, the post 11 is a tubular member through which the proximate section of the rope 20 extends. A lengthwise slot 23 is defined in a side wall of the post 11 for accommodating movement of the parasol opening device 30. The slot 23 extends along the post 11 for a predetermined length whereby the parasol opening device 30 is allowed to move along the post 11 between the closed position and the open position. To guide the movement of the parasol opening device 30, the parasol opening device 30 comprises two pairs of rollers 45 movable along inner surfaces of the post 11 on opposite sides of the slot 23.

The parasol opening device 30 comprises a casing 31 partially surrounding and movably mounted to the post 11. A movement control mechanism 40 is arranged inside the casing 30 and is partially and movably received in the post 11 through the slot 23. The movement control mechanism 40 comprises a base 41 having two spaced walls defining a space therebetween for receiving a gear train. The gear train comprises an input gear 42 pivoted between the spaced walls of the base 41. A crank arm 32 located outside the casing 31 is fixed to the input gear 42 by the pivot of the input gear 42 whereby the input gear 42 can be manually driven by rotating the crank arm 32. An intermediate gear 43 is pivotally supported between the walls and mating the input gear 42. A pair of output pinions 44 are located on opposite sides of the base 41 and coaxially fixed to the intermediate gear 43 for being rotatable in unison with the intermediate gear 43. A pair of racks 24 are fixed to the inner surfaces of the post 11 on opposite sides of the slot 23 for engaging with the output pinions 44 whereby when the crank arm 32 is manually driven, the engagement between the pinions 44 and the racks 24 forces the parasol opening device 30 to move upward or downward along the post 11. The guide rollers 45 may be positioned on and moving over the racks 24. Alternatively, the guide rollers 45 may be provided with toothed periphery for engaging and moving along the racks 24.

A guide tube 46 is attached to the base 41 of the movement control mechanism 40 for guiding the rope 20 during the movement of the parasol opening device 30 along the post 11.

Figure 8:
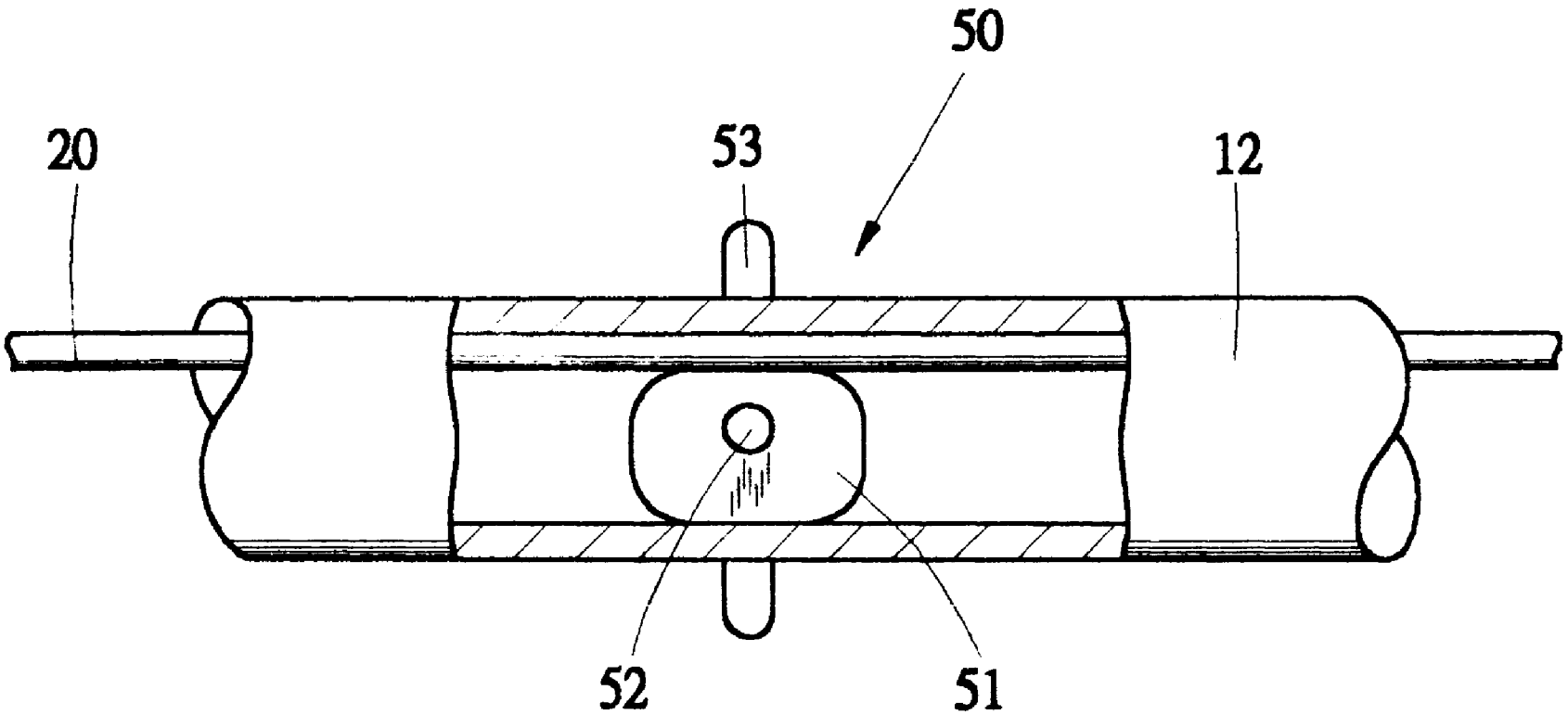
FIG. 8 is a cross-sectional view of a canopy support arm of the parasol showing a rope fixing device arranged therein.

Referring to FIGS. 1–4 and 8, a rope fixing device 50 is arranged inside the canopy support arm 12 for selectively fixing the rope 20 thereby preventing the rope 20 and thus the canopy 15 from movement. In the embodiment illustrated, the rope fixing device 50 comprises a block 51 having round corners. The block 51 is rotatably supported inside the canopy support arm 12 by an eccentric pin 52 to which a knob 53 is fixed whereby manually rotating the knob 53 causes the block 51 to rotate about the pin 52. The block 51 is configured so that when the block 51 is at a released position as shown in FIG. 8, a distance is formed between the block 51 and an inside surface of the canopy support arm 12. The distance is large enough to allow the rope 20 to pass with substantially no constraint. The rotation of the block 51 about the eccentric pin 52 from the released position to a secured position reduces the distance and thus tightly gripping the rope 20 between the block 51 and the inside surface of the canopy support arm 12. This fixes the rope 20 is position.

When the parasol opening device 30 is moved along the post 11 to any desired position between the closed position and the open position by turning the crank arm 32, the user may simply actuate the rope fixing device 50 to fixing the rope 20 and thus the canopy 15. This may fix the parasol at a desired opening condition.

If desired, additional securing means may be provided for securing the parasol opening device 30 and thus the canopy system at any desired opening position.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A parasol and opening device therefore, comprising a tubular post for movably receiving the parasol opening device therein, the parasol opening device being movable along the tubular post between a first position and a second position, an arm having a first end pivotally attached to the parasol opening device and a second end to which a canopy system is pivoted, a link having a first end pivoted to the tubular post and a second end pivotally attached to a slide which is movable along the arm, a rope having a predetermined length extending through at least a portion of the tubular post, the rope having a first end fixed to the tubular post and a second end attached to a runner of the canopy system, whereby displacing the rope causes the canopy system to move between an open position and a closed position, the parasol opening device comprising a movement control device for controlling and guiding the parasol opening device to move along the tubular post between a first position corresponding to the open position of the canopy system and a second position corresponding to the closed position of the canopy system and thereby displacing the rope to operate the canopy system between the open an closed positions.

2. The parasol as claimed in claim 1, wherein the tubular post has an elongate slot formed in a wall thereof, two racks being respectively mounted internal to the tubular post on opposite sides of the slot, the movement control device comprising a pair of output pinions respectively engaging the two racks.

3. The parasol as claimed in claim 1, further comprising rope fixing means arranged inside the arm for selectively reversibly fixing the rope against movement.

4. The parasol as claimed in claim 1, wherein the link has a first end pivoted to an upper end of the post and a second end pivotally attached to the slide that is movable along the arm.

5. The parasol as claimed in claim 1, wherein the first end of the rope is fixed to a lower end of the tubular post, the rope extending through the tubular post, the parasol opening device, a slot formed in the post, a rope fixing means disposed inside the arm and a crown of the canopy system.

6. The parasol as claimed in claim 1, comprising a casing in which the movement control device is disposed, a crank arm for actuating the movement control device and a rope guiding means for guiding the rope, the movement control device being actuated by rotating the crank arm to move the parasol opening device along the tubular post and thus displacing the rope to operate the canopy system.

7. The parasol as claimed in claim 6, wherein the movement control device comprises an input gear coaxially fixed to the crank arm, an intermediate gear mating with the input gear and output pinions being coaxially fixed to the intermediate gear and mating with the racks, whereby rotating the input gear by the crank arm causes the output pinions to move along the racks.

8. The parasol as claimed in claim 7, wherein the movement control device comprises guide rollers movable along inner surfaces of the post on opposite sides of the slot.

9. The parasol as claimed in claim 8, wherein each of the guide rollers has a toothed periphery for engaging a respective one of the racks.

* * * * *